US006797410B2

(12) United States Patent
Ishii et al.

(10) Patent No.: US 6,797,410 B2
(45) Date of Patent: Sep. 28, 2004

(54) HIGH TENSILE STRENGTH HOT DIP PLATED STEEL AND METHOD FOR PRODUCTION THEREOF

(75) Inventors: Kazuhide Ishii, Chiba (JP); Kazuaki Kyono, Kurashiki (JP); Chiaki Kato, Chiba (JP); Kazuo Mochizuki, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 10/129,922

(22) PCT Filed: Sep. 10, 2001

(86) PCT No.: PCT/JP01/07846

§ 371 (c)(1),
(2), (4) Date: May 13, 2002

(87) PCT Pub. No.: WO02/22893

PCT Pub. Date: Mar. 21, 2002

(65) Prior Publication Data

US 2003/0054195 A1 Mar. 20, 2003

(30) Foreign Application Priority Data

Sep. 11, 2000 (JP) ..... 2000-274613
Sep. 12, 2000 (JP) ..... 2000-276524
Sep. 29, 2000 (JP) ..... 2000-301514

(51) Int. Cl.[7] ..... B32B 15/04; B32B 15/18; C21D 6/00; C21D 1/00; B05D 1/18

(52) U.S. Cl. ..... 428/659; 428/653; 428/681; 427/431; 427/433; 427/435; 427/436; 148/516; 148/579; 148/306; 148/307

(58) Field of Search ..... 428/659, 653, 428/704, 649, 681, 684, 687; 148/576, 579, 306, 307, 310, 512; 427/431, 433, 435, 436

(56) References Cited

U.S. PATENT DOCUMENTS

| | | | | | |
|---|---|---|---|---|---|
| 5,175,026 | A | | 12/1992 | Bertol et al. | 427/307 |
| 5,290,370 | A | * | 3/1994 | Okada et al. | 148/330 |
| 5,360,493 | A | * | 11/1994 | Matsuoka et al. | 148/320 |
| 5,578,143 | A | * | 11/1996 | Koyama et al. | 148/319 |
| 6,398,884 | B1 | * | 6/2002 | Kyono et al. | 148/537 |
| 6,428,631 | B1 | * | 8/2002 | Tomokiyo et al. | 148/306 |
| 2002/0197508 | A1 | * | 12/2002 | Yoshinaga et al. | 428/659 |

FOREIGN PATENT DOCUMENTS

| | | | |
|---|---|---|---|
| EP | 0 657 560 | | 1/1998 |
| JP | A 55-122865 | | 9/1980 |
| JP | A 58-104163 | | 6/1983 |
| JP | 05-195075 | * | 8/1993 |
| JP | A 6-287684 | | 10/1994 |
| JP | A 7-70723 | | 3/1995 |
| JP | 7-252624 | | 10/1995 |
| JP | A 8-85858 | | 4/1996 |
| JP | A 9-13147 | | 1/1997 |
| JP | 2000-109966 | | 4/2000 |
| JP | 2000-119831 | * | 4/2000 |
| WO | 00/04200 | * | 1/2000 |

* cited by examiner

*Primary Examiner*—Michael La Villa
(74) *Attorney, Agent, or Firm*—Young & Thompson

(57) ABSTRACT

A steel composition, in which, Si content is regulated to a given range and Nb and Cu or Ni, Mo are compositively added, and a recrystallization annealing is carried out to form an internal oxide layer just beneath a surface of a steel sheet and a surface oxide simultaneously formed on the surface of the steel sheet is removed by pickling. As a result, the formation of oxides of Si, Mn and the like is considerably decreased on the surface of the steel sheet in a subsequent heating before plating because the above internal oxide layer acts as a diffusion barrier. Thus, there can be obtained high tensile strength hot-dipped steel sheets having a considerably excellent plating property.

10 Claims, No Drawings

HIGH TENSILE STRENGTH HOT DIP PLATED STEEL AND METHOD FOR PRODUCTION THEREOF

TECHNICAL FIELD

This invention relates to a high tensile strength hot-dipped steel sheet usable for a vehicle body of an automobile or the like formed by subjecting a surface of a high tensile strength steel sheet to a hot dipping of zinc (including an alloy thereof, the same is applied hereinafter), aluminum, zinc-aluminum alloy, zinc-aluminum-magnesium alloy or the like, and a method of producing the same.

BACKGROUND ART

Recently, the application of high tensile strength hot-dipped steel sheets formed by subjecting a surface of a steel sheet to galvanizing or the like is increasing as a steel sheet for an automobile from viewpoints of safety, weight reduction and low fuel consumption of the automobile and hence global environment protection.

In order to obtain such a high tensile strength hot-dipped steel sheet, it is important to use a steel sheet having an excellent plating property and providing desired strength and workability (press formability or the like) after being passed through a hot dipping bath or further subjected to an alloying treatment as an original sheet.

In general, Si, Mn and so on are added to the steel sheet for increasing the strength of the steel sheet. However, it is known that when the steel sheet added with such elements is subjected to a plating in, for example, a continuous galvanizing line (CGL), the plating property is degraded because oxides of Si, Mn and so on are formed on the surface of the steel sheet at an annealing step before the plating.

This phenomenon is caused due to the fact that when the annealing is carried out in a reducing atmosphere before the plating, since such an atmosphere is reducing for Fe but is oxidative for Si, Mn and the like in steel, Si, Mn and the like are selectively oxidized on the surface of the steel sheet to form oxides.

Since such surface oxides considerably lower a wettability of fused zinc to the steel sheet, the plating property is degraded in the galvanized steel sheet using a high tensile strength steel sheet as an original plating sheet, and particularly, when the contents of Si, Mn and the like are high, there is a problem that the plating is not locally conducted or so-called non-plated portion is formed.

As means for improving the degradation of the plating property in such a high tensile strength steel sheet, for example, JP-A-55-122865 and JP-A-9-13147 propose a method of forcedly oxidizing the steel sheet under a high oxygen partial pressure and then reducing it prior to the heating during the plating. And also, a method of conducting a preliminary plating before the hot dipping is proposed in JP-A-58-104163.

However, the former method has problems that the control of the surface oxide through forcible oxidation is not sufficiently carried out and the stable plating property is not necessarily guaranteed in accordance with components in steel and plating conditions. On the other hand, the latter method has a problem that the production cost rises because an extra process should be added.

Besides, JP-A-6-287684 discloses a high strength steel sheet having an improved plating property by optimizing addition amounts of P, Si and Mn. And also, JP-A-7-70723 and JP-A-8-85858 propose a method wherein a recrystallization annealing is previously carried out before the plating to form a surface oxide and then a galvanizing is carried out after such an oxide is removed by pickling.

By these method could be prevented the occurrence of the non-plated portion in a substantial quantity of high-strength steels.

Even in these methods, however, there is still a problem that the occurrence of the non-plated portion can not be completely prevented as to a type of steel having a higher Si content.

DISCLOSURE OF THE INVENTION

It is an object of the invention to advantageously solve the aforementioned problems and to propose a high tensile strength hot-dipped steel sheet capable of effectively preventing the occurrence of non-plated portions even if a high tensile strength steel sheet having higher contents of Si and Mn is used as an original plating sheet as well as a production method usable therefor.

The inventors have made various studies in order to solve the above problems and obtained a knowledge that a) as components, Nb and Cu or Ni, Mn are compositively added while regulating Si content to a given range,
b) an internal oxide layer is formed just beneath a surface of a steel sheet through an annealing in a continuous annealing line (CAL)(hereinafter referred to as a recrystallization annealing) and a simultaneously formed surface oxide is removed by pickling after the annealing,
c) in a subsequent heating before a plating in a continuous galvanizing line (CGL)(hereinafter referred to as a heating before plating), the formation of oxides of Si, Mn and the like is considerably decreased on the surface of the steel sheet as the above internal oxide layer acts as a diffusion barrier, and hence a big improvement of the plating property can be attained.

The invention is accomplished based on the above knowledge.

That is, the gist and construction of the invention are as follows.

1. A high tensile strength hot-dipped steel sheet provided on a surface of a steel sheet with a hot-dipped layer, characterized in that the hot-dipped steel sheet is obtained by subjecting a steel sheet of a composition comprising C: not more than 0.010 mass % or not less than 0.03 mass % but not more than 0.20 mass %, Nb: not less than 0.005 mass % but not more than 0.2 mass %, not less than 0.03 mass % but not more than 1.5 mass % in total of one or more selected from Cu: less than 0.5 mass %, Ni: less than 1.0 mass % and Mo: less than 1.0 mass %, Al: not more than 0.10 mass %, P: not more than 0.100 mass %, S: not more than 0.010 mass %, N: not more than 0.010 mass %, and further containing, in case of C: not more than 0.010 mass %, Si: not less than 0.25 mass % but not more than 1.2 mass %, Mn: not less than 0.50 mass % but not more than 3.0 mass %, Ti: not more than 0.030 mass %, B: not more than 0.005 mass %, or in case of C: not less than 0.03 mass % but not more than 0.20 mass %, Si: not less than 0.5 mass % but not more than 1.5 mass %, Mn: not less than 1.2 mass % but not more than 3.5 mass % in a range satisfying 1.5×Si(mass %)<Mn(mass %), and the remainder being Fe and inevitable impurities to a recrystallization annealing in a reducing atmosphere having a dew point of not higher than 0° C. but not lower than −45° C. at an annealing temperature of not lower than 750° C., removing oxides formed on a surface of the steel sheet by pickling after the cooling, again heating to a temperature of not lower than 650° C. but not higher than 850° C. in a reducing atmosphere having a dew point of not higher than −20° C., and subjecting to a hot dipping treatment on the way of dropping temperature from the reheating temperature.

2. A high tensile strength hot-dipped steel sheet according to the above item 1, wherein when the C amount is not less than 0.03 mass % but not more than 0.20 mass %, one or two of Ti and V are further included in the steel sheet in a range satisfying one of or two in total of Ti and V: not more than 0.5 mass % and Ti(mass %)<5×C(mass %).

3. A high tensile strength hot-dipped steel sheet according to the above item 1 or 2, wherein when the C amount is not less than 0.03 mass % but not more than 0.20 mass %, Cr is further included in the steel sheet in a range satisfying Cr: not more than 0.25 mass % and Si(mass %)>3×Cr (mass %).

4. A method of producing a high tensile strength hot-dipped steel sheet, characterized in that a steel sheet of a composition comprising C: not more than 0.010 mass % or not less than 0.03 mass % but not more than 0.20 mass %, Nb: not less than 0.005 mass % but not more than 0.2 mass %, not less than 0.03 mass % but not more than 1.5 mass % in total of one or more selected from Cu: less than 0.5 mass %, Ni: less than 1.0 mass % and Mo: less than 1.0 mass %, Al: not more than 0.10 mass %, P: not more than 0.100 mass %, S: not more than 0.010 mass %, N: not more than 0.010 mass %, and further containing, in case of C: not more than 0.010 mass %, Si: not less than 0.25 mass % but not more than 1.2 mass %, Mn: not less than 0.50 mass % but not more than 3.0 mass %, Ti: not more than 0.030 mass %, B: not more than 0.005 mass %, or in case of C: not more than 0.03 mass % but not more than 0.20 mass %, Si: not less than 0.5 mass % but not more than 1.5 mass %, Mn: not less than 1.2 mass % but not more than 3.5 mass % in a range satisfying 1.5×Si(mass %)<Mn(mass %), and the remainder being Fe and inevitable impurities is subjected to a recrystallization annealing in a reducing atmosphere having a dew point of not higher than 0° C. but not lower than −45° C. at an annealing temperature of not lower than 750° C., and oxides formed on a surface of the steel sheet are removed by pickling after the cooling, and the steel sheet is again heated to a reducing temperature of not lower than 650° C. but not higher than 850° C. in a reducing atmosphere having a dew point of not higher than −20° C., and subjected to a hot dipping treatment on the way of dropping temperature from the reheating temperature.

5. A method of producing a high tensile strength hot-dipped steel sheet according to the above item 4, wherein when the C amount is not less than 0.03 mass % but not more than 0.20 mass %, one or two of Ti and V are further included in the steel sheet in a range satisfying one of or two in total of Ti and V: not more than 0.5 mass % and Ti(mass %)<5×C(mass %).

6. A method of producing a high tensile strength hot-dipped steel sheet according to the above item 4 or 5, wherein when the C amount is not less than 0.03 mass % but not more than 0.20 mass %, Cr is further included in the steel sheet in a range satisfying Cr: not more than 0.25 mass % and Si(mass %)>3×Cr(mass %).

The invention mainly lies in a feature that Nb and Cu or Ni, Mn are compositively added while appropriating Si content, and an internal oxide layer is formed just beneath a surface of a steel sheet in the recrystallization annealing, and surface oxides simultaneously formed on the surface of the steel sheet are removed by pickling and then the steel sheet is subjected to the heating before plating and further to a hot dipping.

The reason why the composition range and the production conditions of the recrystallization annealing, heating before plating and the like according to the invention are limited to the above ranges will be described below.

In the invention, the range of C content is divided into two regions, whereby there can be obtained a high tensile strength hot-dipped steel sheet having a tensile strength of 400–600 MPa grade and an excellent ductility and a high tensile strength hot-dipped steel sheet wherein the ductility is somewhat lowered and the tensile strength is as very high as 500–1200 MPa grade.

At first, the invention is described with respect to the high tensile strength hot-dipped steel sheet having a tensile strength of 400–600 MPa grade. In this high tensile strength hot-dipped steel sheet, it is required to limit C content and each content of Si, Mn, Ti and B to the following ranges.

C: Not More than 0.010 Mass %

It is desired to decrease C content for improving elongation and r-value of the steel sheet. Particularly, when the C content exceeds 0.010 mass %, even if proper contents of Ti and Nb are added, the effect of improving properties (particularly press formability) through these elements is not obtained, so that the C content is limited to not more than 0.010 mass %. Moreover, when the content is less than 0.001 mass %, it is difficult to form an internal oxide layer during the recrystallization annealing, so that the C content is favorable to be not less than 0.001 mass %.

Si: Not Less than 0.25 Mass %, Not More than 1.2 Mass %

Si is an element effective for strengthening steel. Heretofore, it was required to decrease Si content as far as possible so as not to form Si oxide on the surface of the steel sheet in the heating before plating. In the invention, however, even if Si is added in an amount of not less than 0.25 mass %, Nb and Cu or Ni, Mo are compositively added to form an internal oxide layer of Si and Mn just beneath the surface of the steel sheet in the recrystallization annealing, which controls the formation of oxides of Si and Mn on the surface of the steel sheet in the subsequent heating before plating, so that the steels according to the invention indicate a good plating property. Moreover, this mechanism is considered due to the fact that the internal oxide layer acts as a diffusion barrier against the movement of Si and Mn in steel to the surface of the steel sheet.

The above effect is never obtained unless Si should be added in an amount of not less than 0.25 mass %. On the other hand, when the Si content exceeds 1.2 mass %, $SiO_2$ is formed on the surface of the steel sheet in the recrystallization annealing and such a surface oxide can not be completely removed at a subsequent pickling step and a part thereof is retained to create a non-plated portion. Therefore, the Si content is limited to a range of 0.25–1.2 mass %.

1.5×Si(mass %)<Mn(mass %)

When the Si content is an amount satisfying a relationship of 1.5×Si(mass %)≧Mn(mass %) in view of Mn content mentioned later, $SiO_2$ is also formed on the surface of the steel sheet in the recrystallization annealing and such a surface oxide can not be completely removed at the subsequent pickling step and hence the non-plated portion is created.

Therefore, it is important that Si is added in a range of 0.25–1.2 mass % and a range satisfying a relationship of 1.5×Si(mass %)<Mn(mass %), respectively.

Mn: Not Less than 0.50 Mass %, Not More than 3.0 Mass %

Mn contributes to enhance the strength but also has an effect of controlling the formation of $SiO_2$ on the surface of the steel sheet in the recrystallization annealing to form a composite oxide of Si and Mn capable of easily removing by pickling. However, when the Mn content is less than 0.50 mass %, the above effect is poor, while when it exceeds 3.0 mass %, Mn oxide is formed on the surface of the steel sheet in the heating before plating to easily create a non-plated portion and also steel is too hardened to hardly conduct cold rolling. Therefore, the Mn content is limited to a range of 0.50–3.0 mass %.

Ti: Not More than 0.030 Mass %

Ti is added, if necessary, because it forms a carbide, a nitride or the like to effectively contribute to the improvement of the workability of steel. However, when Ti is excessively added, surface oxides of Si and Mn formed in the recrystallization annealing become larger and hence it is difficult to remove such oxides by pickling. Therefore, the Ti content is limited to not more than 0.030 mass %. Moreover, Ti is not necessarily added.

B: Not More than 0.005 Mass %

B is an element effective for improving a resistance to secondary work brittleness. However, when B is added in an amount exceeding 0.005 mass %, the effect is not expected over a certain level but is rather degraded in accordance with the annealing conditions. And also, when B is excessively added, hot ductility is lowered. Therefore, B is added in an amount of 0.005 mass % as an upper limit. Moreover, the B content is not particularly critical with respect to the lower limit, but is sufficient to be added in accordance with an improving degree of the required resistance to secondary work brittleness and is desirable to be usually added in an amount of not less than 0.0010 mass %.

Next, the invention is described with respect to the high tensile strength hot-dipped steel sheet having a tensile strength of 500–1200 MPa grade. In this high tensile strength hot-dipped steel sheet, it is required to limit C content and each content of Si and Mn to the following ranges.

C: Not Less Than 0.03 mass %, Not More Than 0.20 mass %

C is an important, basic component in steel and is an element contributing not only to improve the strength through bainite phase or martensite phase produced at a low temperature but also to precipitate carbides of Nb, Ti, V and the like to increase the strength. When the C content is less than 0.03 mass %, not only the above precipitates but also bainite phase and martensite phase are hardly produced, while when it exceeds 0.20 mass %, a spot weldability is degraded, so that the addition range is rendered into 0.03–0.20 mass %. Moreover, a preferable C content is 0.05–0.15 mass %.

Si: Not Less than 0.5 Mass %, Not More than 1.5 Mass %

Si is an element that the C content solid-soluted in α phase is decreased to improve workabilities such as elongation and the like. Heretofore, it was required to decrease Si content as far as possible so as not to form Si oxide on the surface of the steel sheet in the heating before plating. In the invention, however, even if Si is added in an amount of not less than 0.5 mass %, Nb and Cu or Ni, Mo are compositively added to form an internal oxide layer of Si and Mn just beneath the surface of the steel sheet in the recrystallization annealing, which controls the formation of oxides of Si and Mn on the surface of the steel sheet in the subsequent heating before plating, so that the steels according to the invention indicate a good plating property. Moreover, this mechanism is considered due to the fact that the internal oxide layer acts as a diffusion barrier against the movement of Si and Mn in steel to the surface of the steel sheet.

The above effect is never obtained unless Si should be added in an amount of not less than 0.5 mass %. On the other hand, when the C content is 0.03–0.20 mass %, if the Si content exceeds 1.5 mass %, $SiO_2$ is formed on the surface of the steel sheet in the recrystallization annealing and such a surface oxide can not be completely removed at a subsequent pickling step and a part thereof is retained to create a non-plated portion. Therefore, the Si content is limited to a range of 0.5–1.5 mass %.

Moreover, in order to control the occurrence of the non-plated portion even in the steel sheet of 500–1200 MPa grade, the Si content is required to control to a range satisfying 1.5×Si(mass %)<Mn(mass %) in view of Mn content mentioned later likewise the aforementioned case of the steel sheet of 400–600 MPa grade.

Mn: Not Less than 1.2 Mass %, Not More than 3.5 Mass %

Mn has an effect of enriching γ-phase to promote martensite transformation. And also, Mn has an effect that the formation of $SiO_2$ on the surface of the steel sheet in the recrystallization annealing is controlled to form a composite oxide of Si and Mn capable of easily removing by pickling. However, when the Mn content is less than 1.2 mass %, the effect is not obtained, while when it exceeds 3.5 mass %, the spot weldability and plating property are considerably damaged. Therefore, the Mn content is limited to a range of 1.2–3.5 mass %, preferably 1.4–3.0 mass %.

Although the above is described with respect to the reasons on the limited ranges of the respective components inherent to the steel sheets having a tensile strength of 400–600 MPa grade and the steel sheets having a tensile strength of 500–1200 MPa grade, the following elements are required to be added as a component common to both kinds of the steel sheets.

Nb: Not Less than 0.005 Mass %, Not More than 0.2 Mass %

Nb contributes to improve the plating property by making small a crystal grain of the steel sheet produced in the recrystallization annealing to promote the formation of the internal oxide layer of Si and Mn just beneath the surface of the steel sheet. The effect is not obtained unless Nb should be added in an amount of not less than 0.005 mass %. On the other hand, when the Nb content exceeds 0.2 mass %, steel is hardened and hence the hot rolling or the cold rolling is difficult but also the recrystallization annealing is difficult because the recrystallizing temperature is raised and a surface defect is caused. Therefore, the Nb content is limited to a range of 0.005–0.2 mass %.

Not Less than 0.03 Mass % But Not More than 1.5 mass % of One of or More in Total of Cu: Less than 0.5 Mass %, Ni: Less than 1.0 Mass % and Mo: Less than 1.0 Mass %

Cu, Ni and Mo promote the formation of the internal oxide layer of Si and Mn just beneath the surface of the steel sheet in the recrystallization annealing, which controls the formation of oxides of Si and Mn on the surface of the steel sheet in the heating before plating, so that the steels according to the invention indicate a good plating property. This effect is not obtained unless one or more of these elements should be added in an amount in total of not less than 0.03 mass %. On the other hand, when the content in total of these element exceeds 1.5 mass %, or if the Cu content is not less than 0.5 mass %, the Ni content is not less than 1.0 mass % and the Mo content is not less than 1.0 mass %, the surface properties of the hot rolled sheet are degraded. Therefore, these elements are added in amounts of Cu: less than 0.5 mass %, Ni: less than 1.0 mass %, Mo: less than 1.0 mass % and total amount of not less than 0.03 mass % but not more than 1.5 mass %.

Al: Not More than 0.10 Mass %

Al serves as a deoxidizing agent at a steel-making stage but also is useful as an element for fixation of N causing aging degradation as AlN. However, when the Al content exceeds 0.10 mass %, not only the rise of the production cost but also the degradation of the surface properties are caused, so that Al is added in an amount of not more than 0.10 mass %. Preferably, it is not more than 0.050 mass %. Moreover, when the Al content is less than 0.005 mass %, it is difficult to obtain the sufficient deoxidizing effect, so that the lower limit of Al content is favorable to be 0.005 mass %.

P: Not More than 0.100 Mass %

By adding P is increased the strength. However, when the P content exceeds 0.100 mass %, the segregation in the solidification becomes very conspicuous and hence the increase of the strength is saturated and the degradation of the workability is caused and further the resistance to secondary work brittleness is largely degraded and the steel is not substantially durable in use. Therefore, the P content is limited to not more than 0.100 mass %. In case of an alloying galvanization, the P content is favorable to be not more than 0.060 mass % because it brings about the delay of the alloying. However, when the P content is rendered into less than 0.001 mass %, the cost becomes too much, so that it is good to be not less than 0.001 mass %.

S: Not More than 0.010 Mass %

S causes a hot tearing in the hot rolling and induces a breakage of a nugget in a spot welded portion, so that it is desirable to decrease the S content as far as possible. And also, S causes an alloying unevenness in the alloying treatment after the galvanization, so that it is also desirable to decrease as far as possible from this viewpoint. Further, the decrease of the S content contributes to the improvement of the workability through the decrease of S precipitates in steel and the increase of Ti content effective for fixing C. Therefore, the S content is limited to not more than 0.010 mass %. More preferably, it is not more than 0.005 mass %.

N: Not More than 0.010 Mass %

N is desirable to decrease as far as possible for ensuring properties such as ductility, r-value and the like. Particularly, when the N content is not more than 0.010 mass %, a satisfactory effect is obtained, so that the upper limit is 0.010 mass %. Preferably, it is not more than 0.0050 mass %. Nevertheless, the control of the N content to less than 0.0005 mass % brings about the rise of the cost, so that the lower limit is favorable to be 0.0005 mass %.

Although the invention is described with respect to the essential components, when the C content is not less than 0.03 mass % but not more than 0.20 mass %, the following elements may be further added properly.

Ti and/or V: Not More than 0.5 Mass % Under a Condition Satisfying Ti(mass %) <5×C(mass %)

Ti and V are elements forming carbides to render the steel into a higher strength. However, when these elements are added in an amount exceeding 0.5 mass %, a disadvantage is brought in view of the cost and also fine precipitates become too large to obstruct recovery-recrystallization after the cold rolling and degrade the ductility (elongation). Therefore, even when these elements are used alone or in a combination, they are added in an amount of not more than 0.5 mass %. More preferably, the content is 0.005–0.20 mass %.

However, when Ti is added in a range of Ti(mass %)≧5×C(mass %), the Ti content not forming the carbide increases, which is a cause of degrading the plating property, so that Ti is required to be added in a range satisfying Ti(mass %)<5×C(mass %).

Cr: Not More than 0.25 Mass % Under a Condition Satisfying Si(mass %)>3×Cr(mass %)

Cr is an element effective for obtaining a composite structure of ferrite+martensite likewise Mn, but when the Cr content exceeds 0.25 mass % or is Si(mass %)≦3×Cr(mass %), Cr oxide is formed on the surface of the steel sheet in the heating before plating to form a non-plated portion, so that the Cr content is limited to not more than 0.25 mass % under a condition satisfying Si(mass %)>3×Cr(mass %). More preferably, it is not more than 0.20 mass %.

Moreover, the reason why the C content according to the invention is "C: not more than 0.010 mass %" or "C: not less than 0.03 mass % but not more than 0.20 mass" but excludes a range of "C: more than 0.010 mass % but less than 0.03 mass %" is due to the fact that when the C content is within the above excluded range, there is not obtained a product having a particularly excellent property with respect to the strength or workability.

Then, the invention is described with respect to reasons why the recrystallization annealing conditions and the heating conditions before plating are limited to the above ranges.

Moreover, in the production method of the hot-dipped steel sheets according to the invention, steps up to the recrystallization annealing, i.e. hot rolling step and cold rolling step are not particularly restricted, and these steps may be conducted according to usual manner.

Recrystallization Annealing

The recrystallization annealing is carried out by heating to a recrystallizing temperature (usually using CAL) for releasing strain introduced in the cold rolling to provide mechanical properties and workability required for the steel sheet and forming the internal oxide layer of Si and Mn just beneath the surface of the steel sheet.

Because, when such an internal oxide layer is existent, the formation of oxides of Si and Mn is not caused on the surface of the steel sheet at the subsequent heating before plating and the occurrence of the non-plated portion is controlled.

When the recrystallization annealing is carried out below 750° C., the formation of the internal oxide layer is insufficient and the good plating property is not expected, so that it is necessary to conduct the recrystallization annealing above 750° C.

And also, the recrystallization annealing is necessary to be carried out in a reducing atmosphere having a dew point of not higher than 0° C. but not lower than −45° C. Because, when the dew point is higher than 0° C., the oxide is mainly Fe oxide and the internal oxide layer of Si and Mn is hardly formed, while when the dew point is lower than −45° C., oxygen quantity is lacking and the internal oxide layer of Si and Mn is hardly formed. As the reducing atmosphere, nitrogen gas, argon gas, hydrogen gas and carbon monoxide gas may be used alone or in an admixture of two or more gases.

Moreover, a temperature history of the recrystallization annealing is preferable to be a pattern that the temperature is kept at 800–900° C. for 0–120 seconds and then cooled at a rate of about 1–100° C./s.

Removal of Surface Oxide by Pickling

The pickling is carried out for removing the oxides of Si and Mn formed on the surface of the steel sheet in the reducing atmosphere by the recrystallization annealing. As a pickling solution, it is favorable to use 3–30 mass % hydrochloric acid. And also, the pickling time is favorable to be about 3–60 seconds.

Heating Before Plating

The heating before plating is carried out after the oxides of Si and Mn are removed from the surface of the steel sheet by pickling. In the heating before plating, it is preferable to usually use CGL. And also, the heating before plating is carried out in a reducing atmosphere having a dew point of not higher than −20° C. at a temperature of not lower than 650° C. but not higher than 850° C.

Because, when the dew point of the atmosphere is higher than −20° C., a thick Fe oxide is formed on the surface of the steel sheet to bring about the degradation of the plating adhesion. Furthermore, when the annealing temperature is lower than 650° C., the surface of the steel sheet is not activated and the reactivity between molten metal and the steel sheet is not necessarily sufficient, while when it exceeds 850° C., surface oxides of Si and Mn are again formed on the surface of the steel sheet to form non-plated portions. As to the atmosphere, the reducing atmosphere is not necessarily maintained over the whole step, and there may be taken a system that a stage of heating the steel sheet to 400–650° C. is rendered into an oxidizing atmosphere and only the temperature range exceeding the above is rendered into the reducing atmosphere. Further, as the reducing atmosphere, nitrogen gas, argon gas, hydrogen gas and carbon monoxide gas may be used alone or in an admixture of two or more gases.

Moreover, a temperature history of the heating before plating is preferable to be a pattern that the temperature is kept at 700–800° C. for 0–180 seconds and then cooled at a rate of about 1–100° C./s.

In the heating before plating, it is not required to control mechanical properties, and it is enough to heat an original plating sheet to a required temperature prior to a hot dipping. However, it need hardly be said that the control of the mechanical properties may be conducted by the heating before plating.

Hot Dipping

In the invention, a hot dipping is carried out on the way of dropping temperature from the above heating before plating. The method of this hot dipping is not particularly limited, but may be conducted according to the conventionally well-known methods.

For example, in case of a galvanization, hot dipping is carried out by immersing the steel sheet heated before plating in a zinc hot dipping bath having a bath temperature of about 460–490° C. In this case, a sheet temperature inserting into the bath is favorable to be about 460–500° C.

The steel sheet immersed in the zinc hot dipping bath is taken up from the bath and thereafter subjected to a gas wiping treatment to adjust a coating weight to thereby obtain a galvanized steel sheet.

Further, the galvanized steel sheet may be subjected to a subsequent hot alloying treatment to obtain an alloyed galvanized steel sheet.

Moreover, there are an aluminum hot dipping, a zinc-aluminum hot dipping, a zinc-aluminum-magnesium hot dipping and the like as the other hot dipping treatment, which may be carried out according to the conventionally well-known methods.

And also, the coating weight in the hot dipping is favorable to be about 20–100 g/m$^2$ per one-side surface.

BEST MODE FOR CARRYING OUT THE INVENTION

EXAMPLE 1

Slabs having various compositions shown in Table 1 are heated to 1200° C. and hot rolled under a condition of finish rolling temperature: 850–900° C. Then, each of the hot rolled steel bands is pickled and thereafter cold rolled at a rolling reduction of 77% to obtain a cold rolled steel sheet having a thickness of 0.7 mm, which is further subjected to treatments at steps of recrystallization annealing—pickling—heating before plating—hot dipping using CAL and CGL under conditions shown in Table 2. Moreover, as an atmosphere gas, there are used (7 vol % $H_2$+$N_2$) gas in the recrystallization annealing and (5 vol % $H_2$+$N_2$) gas in the heating before plating. Particularly, the heating before plating in No. 12 is carried out up to 600° C. in a burning gas atmosphere containing 1 vol % of oxygen and in (10 vol % $H_2$+$N_2$) gas atmosphere above 600° C.

| Galvanizing conditions | |
|---|---|
| bath temperature: | 470° C. |
| sheet temperature inserted: | 470° C. |
| Al content: | 0.14 mass % |
| coating weight: | 50 g/m$^2$ (per one side surface) |
| dipping time: | 1 second |

100 specimens having a size of 40 mm×80 mm are taken out from each of the thus obtained galvanized steel sheets, from which a specimen(s) observing at least one non-plated portion of not less than 1 mm in diameter is as a rejection.

In Table 2 is shown an acceptable ratio measured from a ratio of acceptable number.

TABLE 1

| Steel | Composition (mass %) | | | | | | | | | | | | | | |
|---|---|---|---|---|---|---|---|---|---|---|---|---|---|---|---|
| Symbol | C | Si | Mn | Cu | Ni | Mo | Nb | Ti | B | Al | P | S | N | Mn-1.5 Si | Remarks |
| A | 0.002 | 0.5 | 1.5 | — | — | — | 0.032 | — | 0.0022 | 0.03 | 0.04 | 0.004 | 0.0020 | 0.75 | Comparative steel |
| B | " | " | " | 0.2 | 0.1 | 0.1 | 0.035 | — | 0.0023 | " | 0.02 | " | " | 0.75 | Acceptable steel |
| C | 0.003 | 1.0 | 2.5 | " | " | 0.3 | 0.022 | — | 0.0008 | 0.02 | 0.03 | 0.003 | 0.0015 | 1.0 | Acceptable steel |

TABLE 1-continued

| Steel | Composition (mass %) | | | | | | | | | | | | | | |
|---|---|---|---|---|---|---|---|---|---|---|---|---|---|---|---|
| Symbol | C | Si | Mn | Cu | Ni | Mo | Nb | Ti | B | Al | P | S | N | Mn-1.5 Si | Remarks |
| D | 0.002 | 1.6 | 2.0 | " | " | 0.1 | 0.031 | — | 0.0018 | 0.03 | 0.04 | 0.004 | 0.0020 | −0.4 | Comparative steel |
| E | " | 0.5 | 1.5 | " | " | " | 0.001 | 0.045 | 0.0022 | " | 0.05 | 0.003 | 0.0015 | 0.75 | Comparative steel |
| F | " | 0.4 | 2.0 | " | 0.4 | — | 0.039 | 0.002 | 0.0019 | " | 0.02 | 0.004 | " | 1.4 | Acceptable steel |
| G | " | " | " | — | — | 0.1 | 0.035 | — | 0.0018 | " | " | " | 0.0020 | 1.4 | Acceptable steel |
| H | 0.003 | 0.7 | 0.8 | 0.2 | 0.1 | " | 0.051 | — | 0.0018 | " | 0.03 | 0.003 | 0.0025 | −0.25 | Comparative steel |

TABLE 2

| | | Recrystallization annealing | | | Annealing before plating | | Acceptable | |
|---|---|---|---|---|---|---|---|---|
| No. | Steel symbol | temperature (° C.) × time (s) | dew point (° C.) | Pickling | temperature (° C.) × time (s) | dew point (° C.) | ratio of plating (%) | Remarks |
| 1 | A | 850 × 60 | −30 | Condition 1 | 750 × 40 | −40 | 63 | Comparative Example 1 |
| 2 | B | " | " | Condition 1 | " | " | 100 | Invention Example 1 |
| 3 | C | " | −10 | Condition 2 | " | 50 | 92 | Invention Example 2 |
| 4 | D | " | −30 | Condition 1 | " | −40 | 34 | Comparative Example 2 |
| 5 | E | " | " | Condition 1 | " | " | 47 | Comparative Example 3 |
| 6 | F | " | " | Condition 1 | " | " | 100 | Invention Example 3 |
| 7 | B | none | — | none | " | " | 0 | Comparative Example 4 |
| 8 | B | 800 × 60 | −30 | Condition 1 | 880 × 40 | " | 23 | Comparative Example 5 |
| 9 | F | 860 × 60 | −40 | Condition 2 | 700 × 40 | −45 | 91 | Invention Example 4 |
| 10 | G | " | −30 | Condition 1 | " | −40 | 100 | Invention Example 5 |
| 11 | H | 850 × 60 | " | Condition 1 | " | " | 0 | Comparative Example 6 |
| 12* | B | " | " | Condition 1 | 750 × 40 | " | 100 | Invention Example 6 |

Condition 1: 5% hydrochloric acid, 60° C., immersion of 5 seconds
Condition 2: 10% hydrochloric acid, 70° C., immersion of 10 seconds
*Annealing before plating: in a burning gas atmosphere containing 1 vol % of oxygen up to 600° C. and in (10 vol % $H_2$ + $N_2$) gas atmosphere above 600° C.

As seen from Table 2, all invention examples have a good plating property as compared with the comparative examples.

Although an alloying treatment is carried out at 490° C. for 60 seconds in the invention examples 1 and 3, the occurrence of alloyed unevenness is not observed.

EXAMPLE 2

Slabs having various compositions shown in Table 3 are heated to 1200° C. and thereafter hot rolled at a finish rolling temperature of 850–900° C. to obtain hot rolled steel sheets having various thicknesses and then pickled. Then, they are cold rolled at a rolling reduction of 50–68% to obtain cold rolled steel sheets having a thickness of 1.2 mm and subjected to treatments at steps of recrystallization annealing—pickling—heating before plating—hot dipping under conditions shown in Table 4 and described below. Particularly, in No. 24 (steel R), the hot rolled steel sheet (thickness: 1.5 mm) is pickled and subjected to treatments at steps of recrystallization annealing—pickling—heating before plating—hot dipping without cold rolling.

Moreover, as an atmosphere gas are used (7 vol % $H_2$+$N_2$) gas in the recrystallization annealing and (5 vol % $H_2$+$N_2$) gas in the heating before plating. Particularly, the heating before plating in No. 25 is carried out up to 600° C. in a burning gas atmosphere containing 1 vol % of oxygen and in (10 vol % $H_2$+$N_2$) gas atmosphere above 600° C.

| Galvanizing conditions | |
|---|---|
| bath temperature: | 470° C. |
| sheet temperature inserted: | 470° C. |
| Al content: | 0.14 mass % |
| coating weight: | 50 g/m$^2$ (per one side surface) |
| dipping time: | 1 second |

10 specimens having a size of 40 mm×80 mm are taken out from each of the thus obtained galvanized steel sheets, from which a specimen(s) observing at least one non-plated portion of not less than 1 mm in diameter is as a rejection.

In Table 4 is shown an acceptable ratio measured from a ratio of acceptable number.

TABLE 3

| Steel | Composition (mass %) | | | | | | | | | | | | | | | |
|---|---|---|---|---|---|---|---|---|---|---|---|---|---|---|---|---|
| Symbol | C | Si | Mn | Cu | Ni | Mo | Nb | Ti | V | Al | P | S | N | Cr | Mn-1.5 Si | Remarks |
| I | 0.07 | 0.7 | 1.5 | — | — | — | 0.001 | — | — | 0.03 | 0.01 | 0.004 | 0.0020 | — | 0.45 | Comparative steel |
| J | 0.07 | 0.7 | 2.0 | 0.2 | 0.1 | 0.1 | 0.007 | — | — | " | " | 0.003 | 0.0020 | 0.10 | 0.85 | Acceptable steel |
| K | 0.12 | 1.0 | 2.5 | — | 0.1 | 0.2 | 0.05 | 0.07 | — | " | " | 0.002 | 0.0020 | — | 1.0 | Acceptable steel |
| L | 0.07 | 1.7 | 2.0 | 0.2 | 0.1 | 0.1 | 0.001 | 0.05 | — | " | " | 0.004 | 0.0020 | — | −0.55 | Comparative steel |
| M | 0.07 | 0.5 | 2.5 | — | 0.4 | — | 0.10 | — | 0.10 | " | " | 0.003 | 0.0015 | — | 2.2 | Acceptable steel |
| N | 0.07 | 1.2 | 3.0 | — | — | 0.3 | 0.035 | 0.01 | — | " | " | 0.002 | 0.0020 | — | 1.2 | Acceptable steel |
| O | 0.09 | 1.0 | 1.2 | — | — | 0.1 | 0.05 | — | — | " | " | 0.004 | 0.0025 | — | −0.3 | Comparative steel |
| P | 0.07 | 0.8 | 2.0 | — | — | 0.1 | 0.05 | — | — | " | " | 0.002 | 0.0020 | — | 0.8 | Acceptable steel |
| Q | 0.16 | 0.8 | 1.4 | — | — | 0.1 | 0.03 | — | — | " | " | 0.002 | 0.0020 | — | 0.2 | Acceptable steel |
| R | 0.08 | 0.7 | 2.0 | — | — | 0.1 | 0.05 | — | — | " | " | 0.002 | 0.0020 | — | 0.95 | Acceptable steel |

TABLE 4

| | | Recrystallization annealing | | | Annealing before plating | | Acceptable | |
|---|---|---|---|---|---|---|---|---|
| No. | Steel symbol | temperature (° C.) × time (s) | dew point (° C.) | Pickling | temperature (° C.) × time (s) | dew point (° C.) | ratio of plating (%) | Remarks |
| 13 | I | 900 × 60 | −30 | Condition 1 | 750 × 40 | −40 | 30 | Comparative Example 7 |
| 14 | J | " | " | Condition 1 | " | " | 100 | Invention Example 7 |
| 15 | " | " | " | none | " | " | 0 | Comparative Example 8 |
| 16 | " | none | none | none | " | " | 0 | Comparative Example 9 |
| 17 | K | 900 × 60 | −30 | Condition 2 | 700 × 40 | −45 | 90 | Invention Example 8 |
| 18 | L | " | " | Condition 1 | 750 × 40 | −40 | 10 | Comparative Example 10 |
| 19 | M | 850 × 60 | " | Condition 1 | " | " | 100 | Invention Example 9 |
| 20 | N | " | " | Condition 1 | " | " | 100 | Comparative Example 11 |
| 21 | O | " | " | Condition 1 | " | " | 0 | Comparative Example 12 |
| 22 | P | " | −25 | Condition 2 | 700 × 40 | −45 | 100 | Invention Example 10 |
| 23 | Q | 800 × 60 | −30 | Condition 2 | " | −40 | 90 | Invention Example 11 |
| 24** | R | 850 × 60 | " | Condition 1 | " | " | 80 | Invention Example 12 |
| 25* | P | " | " | Condition 1 | 750 × 40 | −30 | 100 | Invention Example 13 |

Condition 1: 5% hydrochloric acid, 60° C., immersion of 5 seconds
Condition 2: 10% hydrochloric acid, 70° C., immersion of 5 seconds
*Annealing before plating: in a burning gas atmosphere containing 1 vol % of oxygen up to 600° C. and in (10 vol % $H_2$ + $N_2$) gas atmosphere above 600° C.
**Hot rolled steel sheet (thickness: 1.5 mm) is subjected to treatments of (recrystallization annealing - pickling - heating before plating - hot dipping).

As seen from Table 4, all invention examples have a good plating property as compared with the comparative examples.

Although an alloying treatment is carried out at 490° C. for 60 seconds in the invention examples 7 and 9, the occurrence of alloyed unevenness is not observed.

Industrial Applicability

According to the invention, there can be provided various hot-dipped sheets inclusive of galvanized steel sheets having a high tensile strength and causing substantially no formation of non-plated portion.

And also, the invention is made possible to provide galvanized steel sheets having a good alloying property.

Therefore, it is said that the invention considerably contributes to weight reduction and low fuel consumption of automobiles.

What is claimed:

1. A high tensile strength hot-dipped steel sheet, characterized in that the hot-dipped steel sheet is obtained by subjecting a steel sheet of a composition consisting of:

C: not less than 0.03 mass % and not more than 0.20 mass %,

Nb: not less than 0.005 mass % and not more than 0.2 mass %, not less than 0.03 mass % and notmore than 1.5 mass % in total of one or more selected from Cu: less than 0.5 mass%, Ni: less than 1.0 mass % and Mo: less than 1.0 mass %, Al: not more than 0.10 mass %, P: not more than 0.100 mass %, S: not more than 0.010 mass %, N: not more than 0.010 mass %, and containing Si: not less than 0.5 mass % and not more than 1.5 mass %, Mn: not less than 1.2 mass % and not more than 3.5 mass % in a range satisfying 1.5×Si(mass %)>Mn(mass %), and the remainder being Fe and inevitable impurities to a recrystallization annealing and forming an internal oxide layer in a reducing atmosphere having a dew point of not higher than 0° C. and not lower than −45° C. at an annealing temperature of not lower than 750° C., cooling, removing oxides formed on a surface of the steel sheet by pickling, reheating to a temperature of not lower than 650° C. and not higher than 850° C. in a reducing atmosphere having a dew point of not higher than −20° C., and subjecting to a hot-dipping treatment during the course of cooling own from the reheating temperature to provide a hot-dipping layer on a surface of the steel sheet.

2. A high tensile strength hot-dipped steel sheet, characterized in that the hot-dipped steel sheet is obtained by subjecting a cold rolled steel sheet of a composition comprising:

C: not more than 0.010 mass %,

Nb: not less than 0.005 mass % and not more than 0.2 mass %, not less than 0.03 mass % and not more than 1.5 mass % in total of one or more selected from Cu: less than 0.5 mass %, Ni: less than 1.0 mass % and Mo: less than 1.0 mass %, Al: not more than 0.10 mass %, P: not more than 0.100 mass %, S: not more than 0.010 mass %, N: not more than 0.010 mass %, Si: not less than 0.25 mass % and not more than 1.2 mass %, Mn: not less than 0.50 mass % and not more than 3.0 mass % and in a range satisfying 1.5 ×Si(mass %)<Mn(mass %), Ti: not more than 0.030 mass %, B: not more than 0.005 mass %, and the remainder being Fe and inevitable impurities to a recrystallization annealing and forming an internal oxide layer in a reducing atmosphere having a dew point of not higher than 0° C. and not lower than −45° C. at an annealing temperature of not lower than 750° C., cooling, removing oxides formed on a surface of the steel sheet by pickling, reheating to a temperature of not lower than 650° C. and not higher than 850° C. in a reducing atmosphere having a dew point of not higher than −20° C. and subjecting to a hot-dipping treatment during the course of cooling downward from the reheating step to provide a hot-dipping layer in direct contact with said surface of the steel sheet, formed upon removing said oxides by pickling.

3. A high tensile strength hot-dipped steel sheet, characterized in that the hot-dipped steel sheet is obtained by subjecting a steel sheet of a composition consisting of:

C: not less than0.03 mass % and not more than 0.20 mass %,

Nb: not less than0.005 mass % and not more than 0.2 mass %, not less than 0.03 mass % and not more than 1.5 mass % in total of one or more selected from Cu: less than 0.5 mass %, Ni: less than 1.0 mass % and Mo: less than 1.0 mass %, Al: not more than 0.10 mass %, P: not more than 0.100 mass %, S: not more than 0.010 mass %, N: not more than 0.010 mass %, Si: not less than 0.5 mass % and not more than 1.5 mass %, Mn: not less than 1.2 mass % and not more than 3.5 mass % in a range satisfying 1.5 ×Si(mass %)<Mn(mass %), at least one of Ti and V in a range satisfying total of Ti and V: not more than 0.5 mass % and Ti(mass %)<5 ×C(mass %), and the remainder being Fe and inevitable impurities to a recrystallization annealing and forming an internal oxide layer in a reducing atmosphere having a dew point of not higher than 0° C. and not lower than −45° C. at an annealing temperature of not lower than 750° C., cooling, removing oxides formed on a surface of the steel sheet by pickling, reheating to a temperature of not lower than 650° C. and not higher than 850° C. in a reducing atmosphere having a dew point of not higher than −20° C., and subjecting to a hot-dipping treatment during the course of cooling down from the reheating temperature to provide a hot-dipping layer on a surface of the steel sheet.

4. A high tensile strength hot-dipped steel sheet, characterized in that the hot-dipped steel sheet is obtained by subjecting a steel sheet of a composition consisting of:

C: not less than 0.03 mass % and not more than 0.20 mas %

Nb: not less than 0.005 mass % and not more than 0.2mass %, not less than 0.03 mass % and not more than 1.5 mass % in total of hone or more selected from Cu: less than 0.5 mass %, Ni: less than 4 1.0 mass % and Mo: less than 1.0 mass %, Al: not more than 0.10 mass %, P: not more than 0.100 mass %, S: not more than 0.010 mass %, N: not more than 0.010 mass %, Si: not less than 0.5 mass % and not more than 1.5 mass %, Mn: not less than 1.2 mass % and not more than 3.5 mass % in a range satisfying 1.5 ×Si(mass %)<Mn(mass %), at least one of Ti and V in a range satisfying total of Ti and V: not more than 0.5 mass % and Ti(mass %)<5 ×C(mass %), Cr: not more than 0.25 mass % and satisfying Si(mass %)>3 ×Cr(mass %), and the remainder being Fe and inevitable impurities to a recrysallization annealing and forming an internal oxide layer in a reducing atmosphere having a dew point of not higher than 0° C. and not lower than −45° C. at an annealing temperature of not lower than 750° C., cooling, removing oxides formed on a surface of the steel sheet by pickling, reheating to a temperature of not lower than 650° C. and not higher than 850° C. in a reducing atmosphere having a dew point of not higher than −20° C., and subjecting to a hot-dipping treatment during the course of cooling down from the reheating temperature to provide a hot-dipping layer on a surface of the steel sheet.

5. A high tensile strength hot-dipped steel sheet, characterized in that the hot-dipped steel sheet is obtained by subjecting a steel sheet of a composition consisting of:

C: not less than 0.03 mass % and not more than 0.20 mass %,

Nb: not less than 0.005 mass % and not more than 0.2 mass %, not less than 0.03 mass % and not more than 1.5 mass % in total of bone or more selected from Cu: less than 0.5 mass %, Ni: less than 1.0 mass % and Mo: less than 1.0 mass %, Al: not more than 0.10 mass %, P: not more than 0.100 mass %, S: not more than 0.010 mass %, N: not more than 0.010 mass %, Si: not less than 0.5 mass % and not more than 1.5 mass %, Mn: not less than 1.2 mass % and not more than 3.5 mass % in a range satisfying 1.5 ×Si(mass %)<Mn(mass %), Cr: not more than 0.25 mass % and satisfying Si(mass %)>3 ×Cr(mass %), and the remainder being Fe and inevitable impurities to a recrystallization annealing and forming an internal oxide layer in a reducing atmosphere having a dew point of not higher than 0° C., and not lower than −45° C. at an annealing temperature of not lower than 750° C., cooling, removing oxides formed on a surface of the steel sheet by pickling, reheating to a temperature of not lower than 650° C. and not higher than 850° C. in a reducing atmosphere having a dew point of not higher than −20° C., and subjecting to a hot-dipping treatment during the course of cooling down from the reheating temperature to provide a hot-dipping layer on a surface of the steel sheet.

6. A method of producing a high tensile strength hot-dipped steel sheet, characterized in that a steel sheet of a composition comprising:

C: not less than 0.03 mass % and not more than 0.20 mass %,

Nb: not less than 0.005 mass % and not more than 0.2 mass %, not less than0.03 mass % and not more than 1.5 mass % in total of one or more selected from Cu: less than 0.5 mass %, Ni: less than 1.0 mass % and Mo: less than 1.0 mass %, Al: not more than 0.10 mass %, P: not more than 0.100 mass %, S: not more than 0.010 mass %, N: not more than 0.010 mass %, and containing Si: not less than 0.5 mass % and not more than 1.5 mass %, Mn: not less than 1.2 mass % and not more than 3.5 mass % in a rang satisfying 1.5 ×Si(mass %)<Mn(mass %), and the remainder being Fe and inevitable impurities is subjected to a recrystallization annealing in a reducing atmosphere having a dew point of not higher than 0° C. and not lower than −45° C. at an annealing temperature of not lower than 750° C. and cooled, and oxides formed on a surface of the steel sheet are removed by pickling, and the steel sheet is reheated to a temperature of not lower than 650° C. and not higher than 850° C. in a reducing atmosphere having a dew point of not higher than −20° C., and subjected to a hot-dipping treatment during the course of cooling down from the reheating temperature.

7. A method of producing a high tensile strength hot-dipped steel sheet according to claim wherein at least one of Ti and V are further included in the steel sheet in a range satisfying total of Ti and V: not more than 0.5 mass % and Ti(mass %)<5 ×C(mass %).

8. A method of producing a high tensile strength hot-dipped steel sheet according to claim 6, wherein Cr is further included in the steel sheet in a range satisfying Cr: not more than 0.25 mass % and Si(mass %)>3 ×Cr (mass %).

9. A method of producing a high tensile strength hot-dipped steel sheet, characterized in that a steel a composition comprising:

C: not more than 0.010 mass %,

Nb: not less than 0.005 mass % and not more than 0.2 mass %, not less than 0.03 mass % and not more than 1.5 mass % in total of one or more selected from Cu: less than 0.5 mass %, Ni: less than 1.0 mass % and Mo: less than 1.0 mass %, Al: not more than 0.10 mass %, P: not more than 0.100 mass %, S: not more than 0.010 mass %, N: not more than 0.010 mass %, Si: not less than 0.25 mass % and not more than 1.2 mass %, Mn: not less than 0.50 mass % and not more than 3.0 mass % in a range satisfying 1.5 ×Si(mass %)<Mn(mass %), Ti: not more than 0.030 mass %, B: not more than 0.005 mass %, and the remainder being Fe and inevitable impurities is subject to a recrystallization annealing in a reducing atmosphere having a dew point of not higher than 0° C. and not lower than −45° C. at an annealing temperature of not lower than 750° C. and cooled, and oxides formed on a surface of the steel sheet are removed by pickling, and the steel sheet is reheated to a temperature of not lower than 650° C. and not higher than 850° C. in a reducing atmosphere having a dew point of not higher than −20° C., and subjected to a hot-dipping treatment during the course of cooling down from the reheating temperature.

10. A method of producing a high tensile strength hot-dipped steel sheet according to claim 7, wherein Cr: is further included in the steel sheet in a range satisfying Cr: not more than 0.25 mass % and Si(mass %)>3 ×Cr(mass %).

* * * * *